US011378288B2

(12) United States Patent
Kim et al.

(10) Patent No.: US 11,378,288 B2
(45) Date of Patent: Jul. 5, 2022

(54) OUTDOOR UNIT OF AIRCONDITIONER

(71) Applicant: SAMSUNG ELECTRONICS CO., LTD., Suwon-si (KR)

(72) Inventors: Munsub Kim, Suwon-si (KR); Youjae Kim, Suwon-si (KR); Hyunho Kim, Suwon-si (KR); Hyeongjoon Seo, Suwon-si (KR); Duhan Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 143 days.

(21) Appl. No.: 16/778,613

(22) Filed: Jan. 31, 2020

(65) Prior Publication Data

US 2020/0248912 A1 Aug. 6, 2020

(30) Foreign Application Priority Data

Jan. 31, 2019 (KR) ..... 10-2019-0012968

(51) Int. Cl.
*F24F 1/46* (2011.01)
*F24F 1/14* (2011.01)
(Continued)

(52) U.S. Cl.
CPC ..... *F24F 1/46* (2013.01); *F24F 1/14* (2013.01); *F24F 11/84* (2018.01);
(Continued)

(58) Field of Classification Search
CPC .. F24F 1/30; F24F 1/26; F24F 13/0254; F24F 13/0209; F24F 1/14; F24F 11/84;
(Continued)

(56) References Cited

U.S. PATENT DOCUMENTS 5,547,322 A 8/1996 Lilja et al.
2009/0056357 A1 3/2009 Kang et al.
(Continued)

FOREIGN PATENT DOCUMENTS

CN 203837207 U 9/2014
CN 205090680 U 3/2016
(Continued)

OTHER PUBLICATIONS

International Search Report dated May 29, 2020 in International Patent Application No. PCT/KR2020/001331.
(Continued)

*Primary Examiner* — Schyler S Sanks
(74) *Attorney, Agent, or Firm* — Staas & Halsey LLP

(57) ABSTRACT

An outdoor unit of an air conditioner having an expansion valve unit. The outdoor unit of the air conditioner includes a compressor, a heat exchanger configured to exchange heat between outdoor air and refrigerant compressed by the compressor, an expansion valve unit configured to decompress the refrigerant discharged from the heat exchanger, a refrigerant pipe configured to deliver the refrigerant, which is decompressed and expanded by the expansion valve unit, to the indoor unit of the air conditioner, and a bracket configured to support the expansion valve unit. The expansion valve unit includes an expansion valve, a first connection portion configured to connect the expansion valve to the heat exchanger, and a second connection portion configured to connect the expansion valve to the refrigerant pipe. The expansion valve, and one of the first connection portion or the second connection portion are fixed to the bracket.

18 Claims, 9 Drawing Sheets

(51) Int. Cl.
*F24F 11/84* (2018.01)
*F24F 13/02* (2006.01)
*F25B 41/31* (2021.01)

(52) U.S. Cl.
CPC ..... *F24F 13/0209* (2013.01); *F24F 13/0254* (2013.01); *F25B 41/31* (2021.01)

(58) Field of Classification Search
CPC ..... F24F 1/46; F25B 41/39; F25B 2313/005; F16B 2/14; F16B 2/06; F16L 55/07
See application file for complete search history.

(56) References Cited

U.S. PATENT DOCUMENTS

| | | | | |
|---|---|---|---|---|
| 2011/0219799 | A1* | 9/2011 | Park | F24F 1/26 62/149 |
| 2011/0219803 | A1 | 9/2011 | Park et al. | |
| 2012/0000230 | A1* | 1/2012 | Matsuura | F24F 1/32 62/259.1 |
| 2018/0003420 | A1 | 1/2018 | Rasmussen | |
| 2020/0018530 | A1* | 1/2020 | Tashiro | F25B 41/30 |

FOREIGN PATENT DOCUMENTS

| | | | | |
|---|---|---|---|---|
| EP | 2 365 253 | A2 | 9/2011 | |
| EP | 2 365 253 | A3 | 12/2014 | |
| EP | 3 048 390 | A1 | 7/2016 | |
| JP | 9-196515 | A | 7/1997 | |
| JP | 10-96540 | A | 4/1998 | |
| KR | 20-1998-0012019 | | 5/1998 | |
| KR | 10-2007-0081239 | | 8/2007 | |
| KR | 10-2014-0139318 | | 12/2014 | |
| KR | 10-2018-104560 | | 9/2018 | |
| WO | WO-2018078808 | A1 * | 5/2018 | F25B 41/37 |

OTHER PUBLICATIONS

Supplementary European Search Report dated Jan. 28, 2022 in European Application No. 20748510.3.

* cited by examiner

OUTDOOR UNIT OF AIRCONDITIONER

CROSS-REFERENCE TO RELATED APPLICATION(S)

This application is based on and claims priority under 35 U.S.C. § 119 to Korean Patent Application No. 10-2019-0012968, filed on Jan. 31, 2019, in the Korean Intellectual Property Office, the disclosure of which is incorporated by reference herein in its entirety.

BACKGROUND

1. Field

The disclosure relates to an outdoor unit of an air conditioner having an expansion valve unit.

2. Description of Related Art

In general, an air conditioner is a device including a refrigeration cycle, and the type of the air conditioner includes a split type air conditioner including an indoor unit arranged in an indoor space and an outdoor unit arranged in an outdoor space.

The outdoor unit of the air conditioner includes an outdoor heat exchanger for exchanging heat with outdoor air, a compressor for compressing the refrigerant, an expansion valve unit for decompressing the refrigerant, and a housing for accommodating the outdoor heat exchanger, the expansion valve unit, and the compressor.

The expansion valve unit additionally includes a capillary tube to optimize the flow rate of the refrigerant, and the tube of the capillary tube is formed thin, which causes a risk of damage.

SUMMARY

Therefore, it is an aspect of the disclosure to provide an outdoor unit of an air conditioner capable of stably fixing an expansion valve unit so as to prevent damage to the expansion valve unit.

Additional aspects of the disclosure will be set forth in part in the description which follows and, in part, will be obvious from the description, or may be learned by practice of the disclosure.

In accordance with an aspect of the disclosure, an outdoor unit of an air conditioner connectable to an indoor unit, the outdoor unit includes a compressor, a heat exchanger configured to exchange heat between air introduced from outside and refrigerant compressed by the compressor, an expansion valve unit configured to decompress the refrigerant discharged from the heat exchanger the expansion valve unit comprising an expansion valve, a first connection portion configured to connect the expansion valve to the heat exchanger and a second connection portion configured to connect the expansion valve to the refrigerant pipe, a refrigerant pipe configured to deliver the refrigerant, which is decompressed and expanded by the expansion valve unit, to the indoor unit when the indoor unit is connected to the outdoor unit, and a bracket configured to support the expansion valve unit by fixing the expansion valve, and one of the first connection portion or the second connection portion thereto.

The one of the first connection portion or the second connection portion may include a capillary tube connected to the expansion valve and a connection tube configured to connect the capillary tube to the heat exchanger or the refrigerant pipe, and the capillary tube is fixed to the bracket.

The one of the first connection portion or the second connection portion may include a capillary tube connected to the expansion valve and a connection tube configured to connect the capillary tube to the heat exchanger or the refrigerant pipe, and the connection tube is fixed to the bracket.

The expansion valve may be fixed to one surface of the bracket, and the one of the first connection portion or the second connection portion may be fixed to the other surface of the bracket.

The expansion valve may be fixed to one side of the bracket, and the one of the first connection portion or the second connection portion may be fixed to the other side of the bracket.

The capillary tube may include one end thereof connected to the connection tube and the other end thereof connected to the expansion valve, and the bracket may fix the expansion valve and the connection tube to maintain a separation distance in a direction perpendicular to an extending direction of the one end and the other end of the capillary tube.

The outdoor unit of the air conditioner may further include a first coupling member configured to surround at least a portion of the expansion valve and coupled to the bracket so as to allow the expansion valve to be coupled to the bracket.

The first coupling member may include a rubber material.

The first coupling member may include a first cutout portion, a first support configured to support at least one portion of the expansion valve after a lower end of the expansion valve is inserted through the first cutout portion, and a first coupling portion extending from the first cutout portion and then coupled to the bracket.

The first coupling portion may include a support protrusion configured to allow the first coupling portion to be supported by the bracket without being separated from the bracket after the first coupling portion is inserted into the bracket.

The bracket may include a coupling hook including an insertion portion to which the first coupling portion is inserted.

The coupling hook may be arranged at one side end of the bracket.

The outdoor unit of the air conditioner may further include a second coupling member configured to surround one of the first connection portion or the second connection portion and coupled to the bracket so as to allow the one of the first connection portion or the second connection portion to be coupled to the bracket.

The second coupling member may include a second support configured to surround the one of the first connection portion or the second connection portion and support the one of the first connection portion or the second connection portion, and a second coupling portion coupled to the bracket.

The second coupling portion may be screwed to the bracket, and the bracket may further include a coupling hole to which the second coupling portion is screwed.

In accordance with another aspect of the disclosure, an outdoor unit of an air conditioner connectable to an indoor unit, the outdoor unit includes a compressor, a heat exchanger configured to exchange heat between air introduced from outside and refrigerant compressed by the compressor, an expansion valve unit configured to decompress the refrigerant discharged from the heat exchanger, the expansion valve unit comprising an expansion valve, a first connection portion configured to connect the expansion valve to the heat exchanger and a second connection portion configured to connect the expansion valve to the refrigerant pipe; a refrigerant pipe configured to deliver the refrigerant, which is decompressed and expanded by the expansion valve unit, to the indoor unit when the indoor unit is connected to the outdoor unit, and a bracket configured to support the expansion valve unit by fixing the expansion valve to one surface of the bracket, and by fixing one of the first connection portion or the second connection portion to the other surface of the bracket.

The outdoor unit of the air conditioner may further include a first coupling member configured to surround a lower portion of the expansion valve and coupled to the bracket so as to allow the lower portion of the expansion valve to be coupled to the bracket, and a second coupling member configured to surround one of the first connection portion or the second connection portion and coupled to the bracket so as to allow the one of the first connection portion or the second connection portion to be coupled to the bracket.

The bracket may include a coupling hook including an insertion portion to which the first coupling member is inserted, and a coupling hole to which the second coupling member is screwed, and the coupling hook may be arranged on one side of the bracket and the coupling hole may be arranged on the other side of the bracket.

The first coupling member may include a rubber material.

In accordance with another aspect of the disclosure, an outdoor unit of an air conditioner connectable to an indoor unit, the outdoor unit includes a compressor, a heat exchanger configured to exchange heat between air introduced from outside and refrigerant compressed by the compressor, an expansion valve unit configured to decompress the refrigerant discharged from the heat exchanger, the expansion valve unit comprising an expansion valve configured to decompress refrigerant, a capillary tube comprising one end thereof connected to the expansion valve, and a connection tube configured to connect the other end of the capillary tube to the heat exchanger or the refrigerant pipe, a refrigerant pipe configured to deliver the refrigerant, which is decompressed and expanded by the expansion valve unit, to the indoor unit of the air conditioner, and a bracket configured to support the expansion valve unit by fixing the expansion valve and the connection tube thereto to maintain a separation distance in a direction perpendicular to an extending direction of the one end and the other end of the capillary tube.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
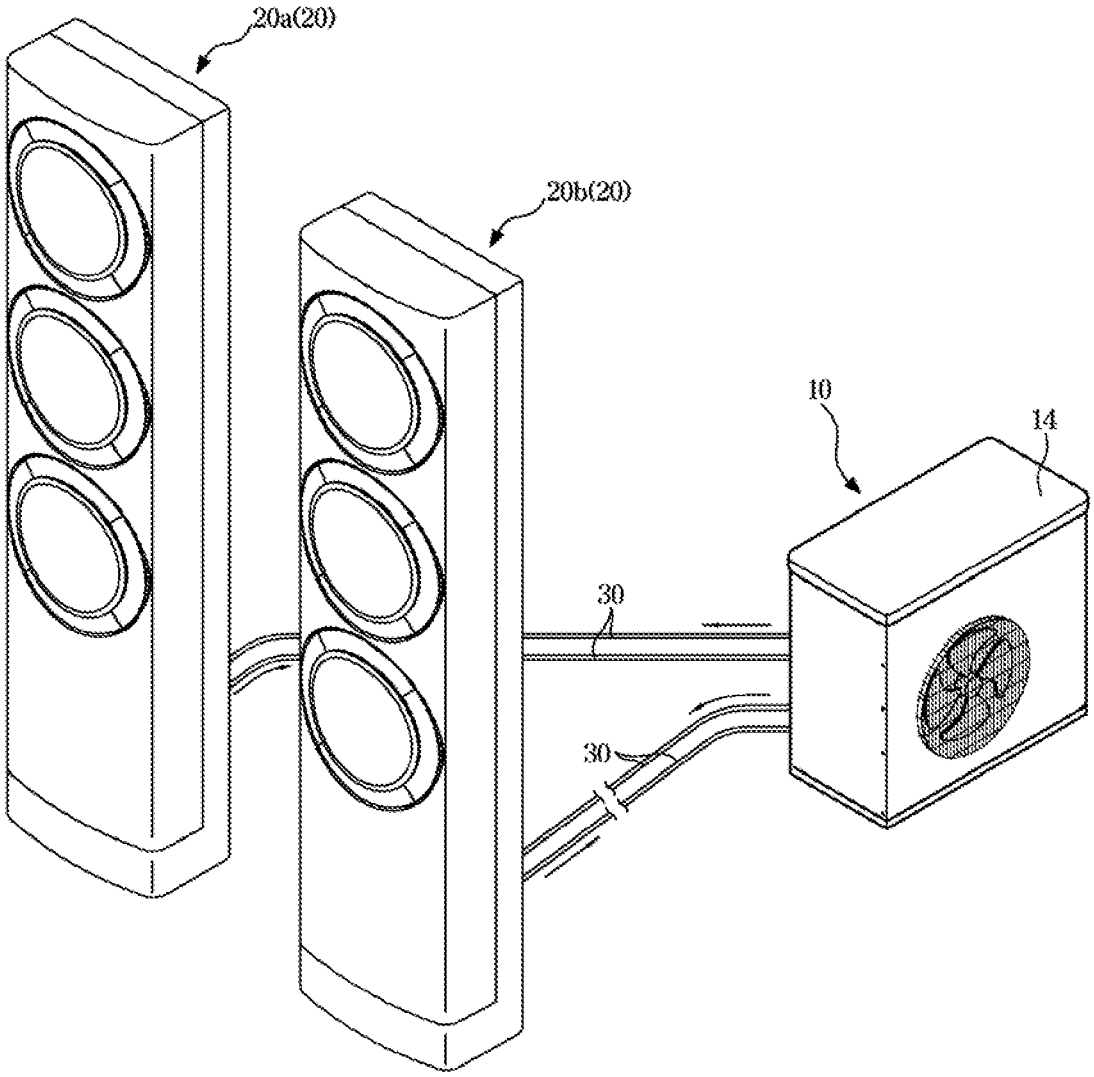
FIG. 1 is a schematic diagram of an air conditioner according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

The term of "upper side", "upward", "lower side", and "downward" used in the description may be defined by the up and down direction of the outdoor unit of the air conditioner according to an embodiment, as illustrated in FIG. 1. That is, a side corresponding to an upper side of a heat exchanger of FIG. 1 represents an upper side, and a side corresponding to a lower side of the heat exchanger of FIG. 1 represents a lower side.

In addition, as for the term "front side" and "rear side" used in the description, a direction, to which a front surface of the heat exchanger according to an embodiment of FIG. 1 is directed, represents "front side" and a direction, to which a rear surface of the heat exchanger is directed, represents "rear side".

Hereinafter the disclosure will be described more fully with reference to the accompanying drawings.

Figure 2:
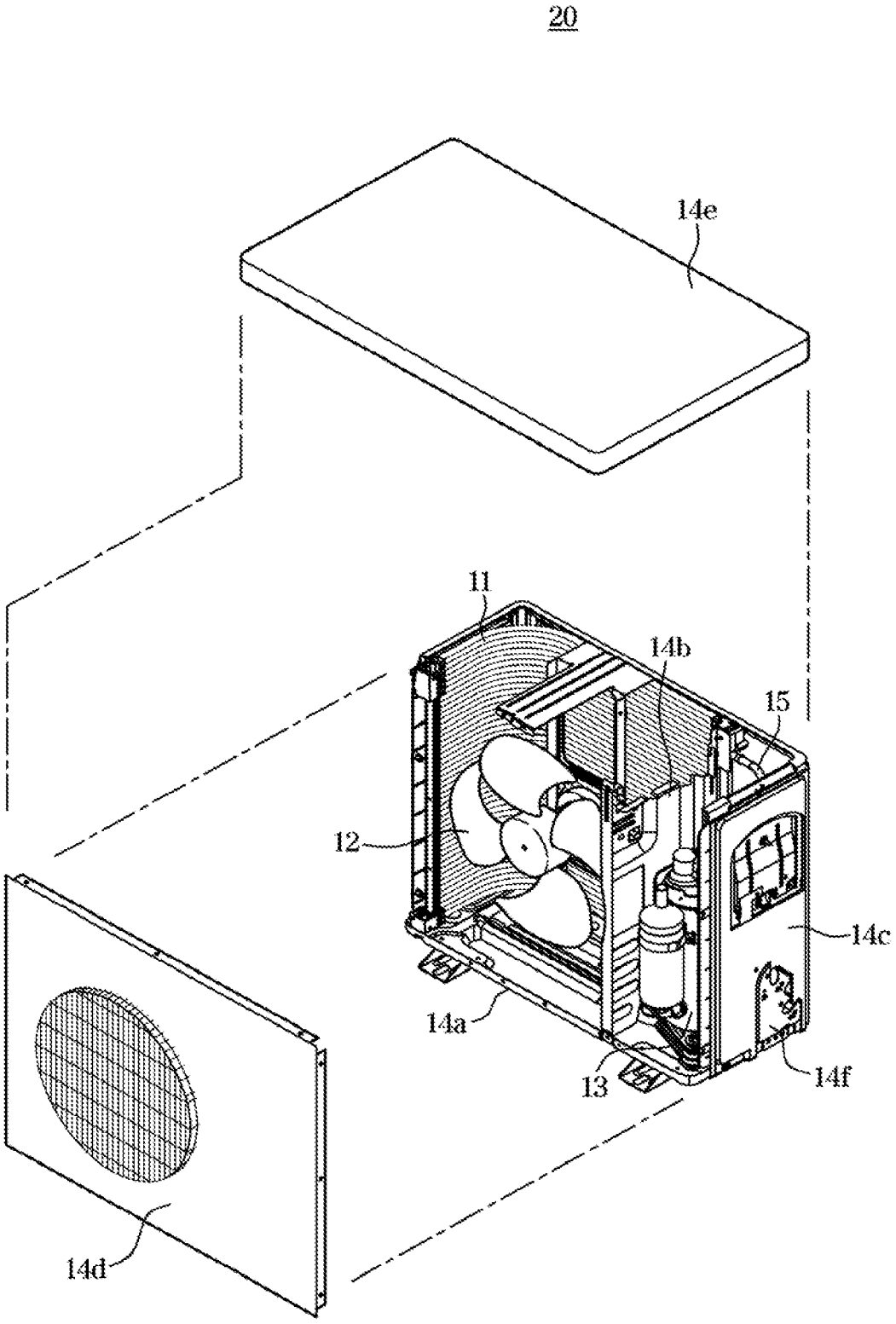
FIG. 2 is an exploded perspective view of an outdoor unit of the air conditioner according to an embodiment of the disclosure.
Figure 3:
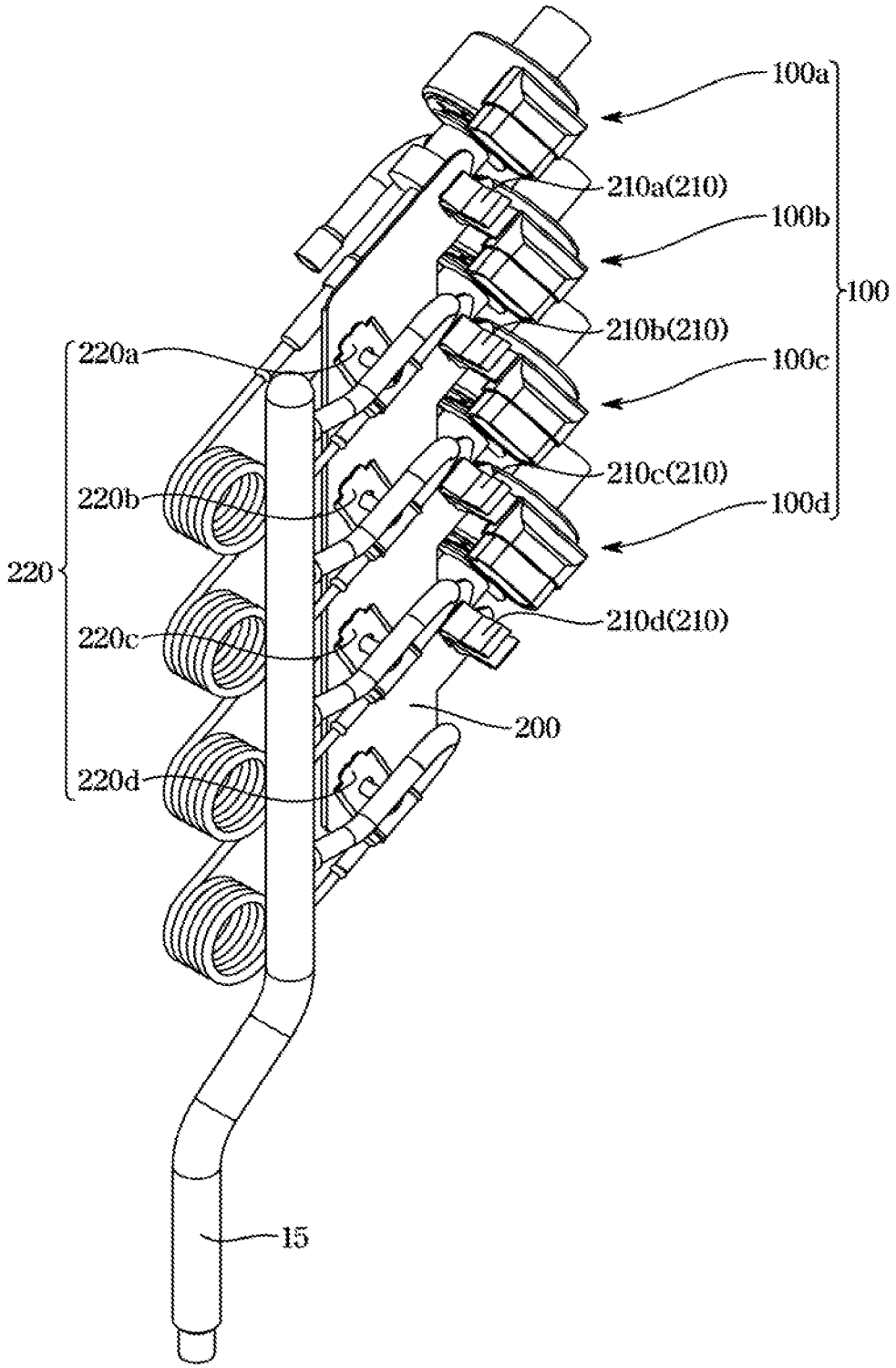
FIG. 3 is a perspective view illustrating a state in which an expansion valve unit is fixed to a bracket in the air conditioner according to an embodiment of the disclosure.
Figure 4:
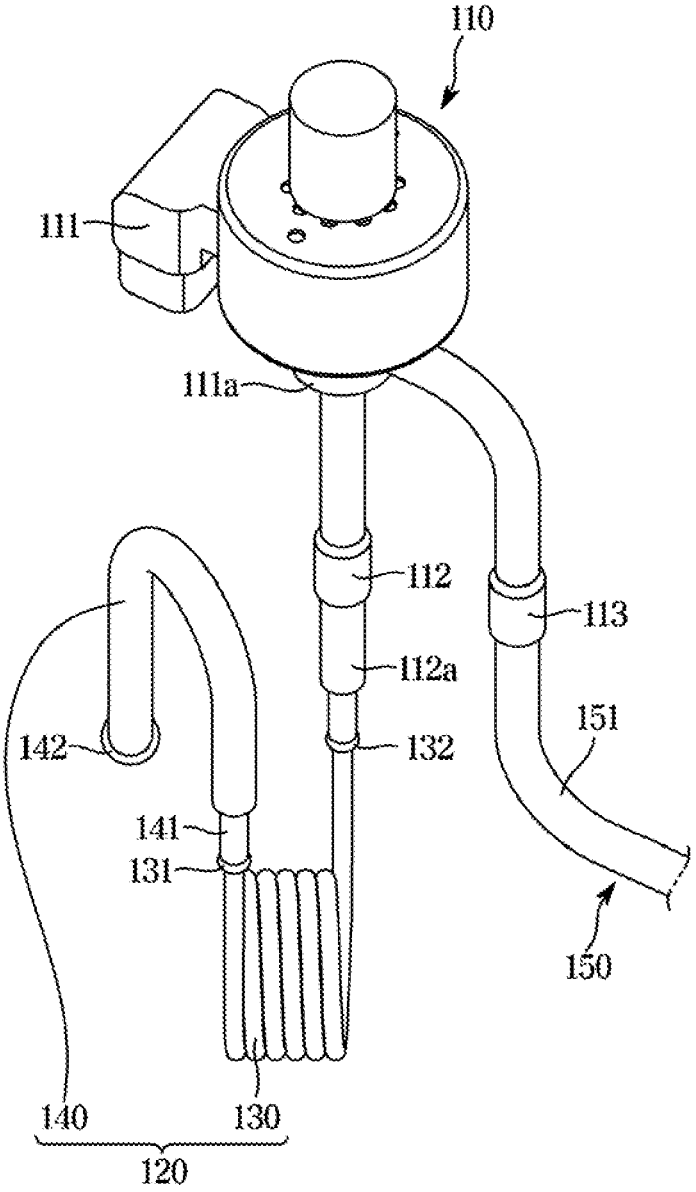
FIG. 4 is a perspective view of the expansion valve unit in the air conditioner according to an embodiment of the disclosure.

FIG. 1 is a schematic diagram of an air conditioner according to an embodiment of the disclosure, FIG. 2 is an exploded perspective view of an outdoor unit of the air conditioner according to an embodiment of the disclosure, FIG. 3 is a perspective view illustrating a state in which an expansion valve unit is fixed to a bracket in the air conditioner according to an embodiment of the disclosure, and FIG. 4 is a perspective view of the expansion valve unit in the air conditioner according to an embodiment of the disclosure.

As illustrated in FIG. 1, an air conditioner according to an embodiment of the disclosure includes an indoor unit 20 arranged in an indoor space and an outdoor unit 10 arranged in an outdoor space, and the outdoor unit 10 and the indoor unit 20 are connected to each other through a refrigerant pipe 30 configured to deliver refrigerant. In addition, although not shown in the drawings, the indoor unit 20 and the outdoor unit 10 may be connected to each other through wires for transmitting power and electric signals.

A single outdoor unit 10 may be connected to the plurality of indoor units 20*a* and 20*b* through the refrigerant pipe 30. FIG. 1 illustrates an example in which a plurality of indoor units 20*a* and 20*b* is provided, but a single indoor unit 20 or three or more indoor units 20 may be connected to a single outdoor unit 10.

The indoor unit 20 includes an indoor heat exchanger (not shown) configured to exchange heat with indoor air, an indoor blower fan (not shown) configured to suck and blow indoor air to pass through the indoor heat exchanger, and an expansion valve unit 100 (refer to FIG. 3) configured to decompress and expand the refrigerant.

As illustrated in FIG. 2, the outdoor unit 10 includes a heat exchanger 11 configured to exchange heat with outdoor air, a blower fan 12 configured to suck and blow outdoor air to pass through the heat exchanger 11, a compressor 13 configured to compress the refrigerant, and a housing 14 configured to form an appearance of the outdoor unit 10 and accommodate the above mentioned heat exchanger 11, blower fan 12 and compressor 13.

Referring to FIG. 2, the housing 14 include a base plate 14*a* forming a lower surface of the housing to allow the heat exchanger 11 and the compressor 13 to be placed thereon, a partition 14*b* installed between the heat exchanger 11 and the compressor 13 to divide an inner space of the housing 14 into a space in which the outdoor heat exchanger 11 is installed and a space in which the compressor 13 is installed, a side plate 14*c* formed in a rectangular shape having an open front side so that an inside thereof forms a space in which the heat exchanger 11 and the compressor 13 are installed, a front plate 14*d* configured to cover the front side of the side plate 14*c*, and a top plate 14*e* configured to cover the upper side of the side plate 14*c* and the front plate 14*d*.

The side plate 14*c* includes an inlet port (not shown) through which outdoor air is sucked, and the front plate 14*d* includes an outlet port through which air heat-exchanged with the heat exchanger 11 is discharged back to the outdoor space.

In addition, the housing 14 includes a control box (not shown) installed on the inner surface of the side plate 14*c* and a valve plate 14*f* on which a valve (not shown), to which the refrigerant pipe 30 is connected, is installed.

The outdoor unit 10 may include a discharge pipe 15 through which the refrigerant passing through the heat exchanger 11 is discharged. The discharge pipe 15 may be formed as a part of the heat exchanger 11.

The discharge pipe 15 may connect the heat exchanger 11 to the expansion valve unit 100, as illustrated in FIG. 3.

The refrigerant introduced into the expansion valve unit 100 through the discharge pipe 15 may be decompressed and expanded, and then moved to the indoor unit 20 through the refrigerant pipe 30.

As illustrated in FIG. 4, the expansion valve unit 100 may include an expansion valve 110 through which the refrigerant is decompressed and expanded.

The expansion valve 110 may include a first tube 112 through which the refrigerant is introduced, a body portion 111 configured to decompress and expand the refrigerant introduced from the first tube 112, and a second tube 113 through which the decompressed and expanded refrigerant is discharged.

The expansion valve unit 100 may include a first connection portion 120 configured to connect the discharge pipe 15 to the first tube 112 and a second connection portion 150 configured to connect the second tube 113 and the refrigerant pipe 30.

The first connection portion 120 may be configured to allow the refrigerant, which is heat-exchanged in the heat exchanger 11, to flow into the expansion valve 110.

The second connection portion 150 may be configured to allow the refrigerant, which is expanded and decompressed by the expansion valve 110, to flow into the indoor unit 20.

The first connection portion 120 may include a capillary tube 130 configured to optimize the flow rate of the refrigerant. The first connection portion 120 may include a first connection tube 140 configured to connect the capillary tube 130 to the discharge pipe 15.

One end 141 of the first connection tube 140 may be connected to one end 131 of the capillary tube 130, and the first tube 112 may be connected to the one end 131 of the capillary tube 130. Other end 142 of the first connection tube 140 may be connected to the discharge pipe 15.

Therefore, the capillary tube 130 may be arranged at the front end of the expansion valve 110 based on the flow of the refrigerant.

An auxiliary tube 112*a* configured to connect the first tube 112 to the capillary tube 130 may be provided between the first tube 112 and the capillary tube 130. However, the connection of the capillary tube 130 is not limited thereto, and thus the capillary tube 130 may be directly connected to the first tube 112.

The second connection portion 150 may include a second connection tube 151 configured to connect the second tube 113 to the refrigerant pipe 30.

Although not shown in the drawing, the capillary tube 130 may be included in the second connection portion 150 instead of the first connection portion 120 and thus the capillary tube may be connected to the rear end of the expansion valve 110 based on the flow of the refrigerant. That is, the capillary tube 130 may be arranged between the second tube 113 and the second connection tube 151.

In this case, the second connection portion 150 may be connected to the bracket 200 described later. However, only an embodiment in which the capillary tube 130 is included in the first connection portion 120 and arranged between the first tube 112 and the first connector tube 140 will be described.

As mentioned above, the expansion valve unit 100 may include the capillary tube 130, and the capillary tube 130 may include a thin tube, which may cause the deformation and damage of the capillary tube 130 due to an external force.

In addition, a configuration in which the expansion valve unit 100 is connected to the capillary tube 130 may be deformed or damaged by an external force.

"External force" includes a force that is applied from the outside of the outdoor unit 10 or vibration generated upon driving of the blower fan 12 or the compressor 13 arranged inside the outdoor unit 10.

Particularly, the capillary tube 130 may be arranged at the front end or the rear end of the expansion valve 110. The expansion valve 110 is generally formed of a metal material, and the weight of the expansion valve 110 is relatively heavy.

Accordingly, the external force formed by the weight of the expansion valve 110 is largely transmitted to the capillary tube 130 that is physically connected to the expansion valve 110, and thus the capillary tube 130 or a configuration coupled to the capillary tube 130 may be deformed or damaged.

Particularly, the expansion valve unit 100 may be arranged in a machine room formed between the partition 14*b* and the side plate 14*c* as illustrated in FIG. 2. Typically, the outdoor unit 10 of the air conditioner may be manufactured to maximize the size of the heat exchanger 11 and the blower fan 12 in order to increase the efficiency of the outdoor unit 10, and thus the space inside the machine room may be narrow.

Because the machine room is narrow, when the configuration of the expansion valve unit 100 connected to the capillary tube 130 or the capillary tube 130 is deformed, the configuration or the capillary tube 130 may be in contact with a piping structure, which is arranged adjacent to the expansion valve unit 100. Therefore, additional damage may occur and an unintentional noise caused by the contact between the components may occur.

In addition, when a plurality of indoor units 20*a* and 20*b* is connected to a single outdoor unit 10 as illustrated in FIGS. 1 to 3, a plurality of expansion valve units 100*a*, 100*b*, 100*c*, and 100*d* may be arranged in the machine room. Therefore, the expansion valve units 100*a*, 100*b*, 100*c*, and 100*d* may be in contact with each other and damage or noise may occur due to contact.

In order to ease such a difficulty, the outdoor unit 10 of the air conditioner according to an embodiment of the disclosure includes a bracket 200 configured to stably support the expansion valve unit, and a first coupling member 210 and a second coupling member 220 configured to couple the bracket 100 to the expansion valve unit 100.

The bracket 200 may stably support the expansion valve unit 100 to prevent the capillary tube 130 or the configuration connected to the capillary tube 130, which have the weakest rigidity against the external force, from being deformed or damaged by the external force.

The bracket 200 may support the plurality of expansion valve units 100*a*, 100*b*, 100*c*, and 100*d*, as illustrated in FIG. 3.

According to an embodiment of the disclosure, the bracket 200 may support four or less expansion valve units 100*a*, 100*b*, 100*c*, and 100*d*, but the present disclosure is not limited thereto, and thus the bracket 200 may include five or more coupling hooks 203 and coupling holes 205, which are described later, for supporting five or more expansion valve units.

However, hereinafter the bracket 200 configured to support four or less expansion valve units 100*a*, 100*b*, 100*c*, and 100*d* will be described.

Four or less expansion valve units 100*a*, 100*b*, 100*c*, 100*d* may be simultaneously supported by the bracket 200 configured to support four expansion valve units 100*a*, 100*b*, 100*c*, and 100*d*, as illustrated in the drawing, but alternatively, one to three expansion valve unit among four expansion valve units 100*a*, 100*b*, 100*c*, 100*d* may be selectively supported by the bracket 200.

That is, the outdoor unit 10 may include various numbers of expansion valve units 100 according to the number of the indoor units 20 connected to the outdoor unit 10, and one expansion valve unit to four expansion valve units may be supported by a single bracket 200.

The outdoor unit 10 may include a plurality of first coupling members 210*a*, 210*b*, 210*c*, and 210*d* configured to couple the plurality of expansion valve units 100*a*, 100*b*, 100*c*, and 100*d* to the bracket 200, respectively.

The outdoor unit 10 may include a plurality of second coupling members 220*a*, 220*b*, 220*c*, and 220*d* configured to couple the plurality of expansion valve units 100*a*, 100*b*, 100*c*, and 100*d* to the bracket 200, respectively.

Two fixation points fixed to the bracket 200 by the first coupling member 210 and the second coupling member 220 may be formed on the expansion valve unit 100. Accordingly, the expansion valve unit 100 may be stably fixed to the bracket 200.

The number of the first coupling members 210*a*, 210*b*, 210*c* and 210*d* and the number of the second coupling members 220*a*, 220*b*, 220*c* and 220*d* may be selected in accordance with the number of the expansion valve units 100*a*, 100*b*, 100*c*, and 100*d* supported by the bracket 200.

Hereinafter a structure in which the expansion valve unit 100 is coupled to the bracket 200 will be described in detail.

Figure 5:
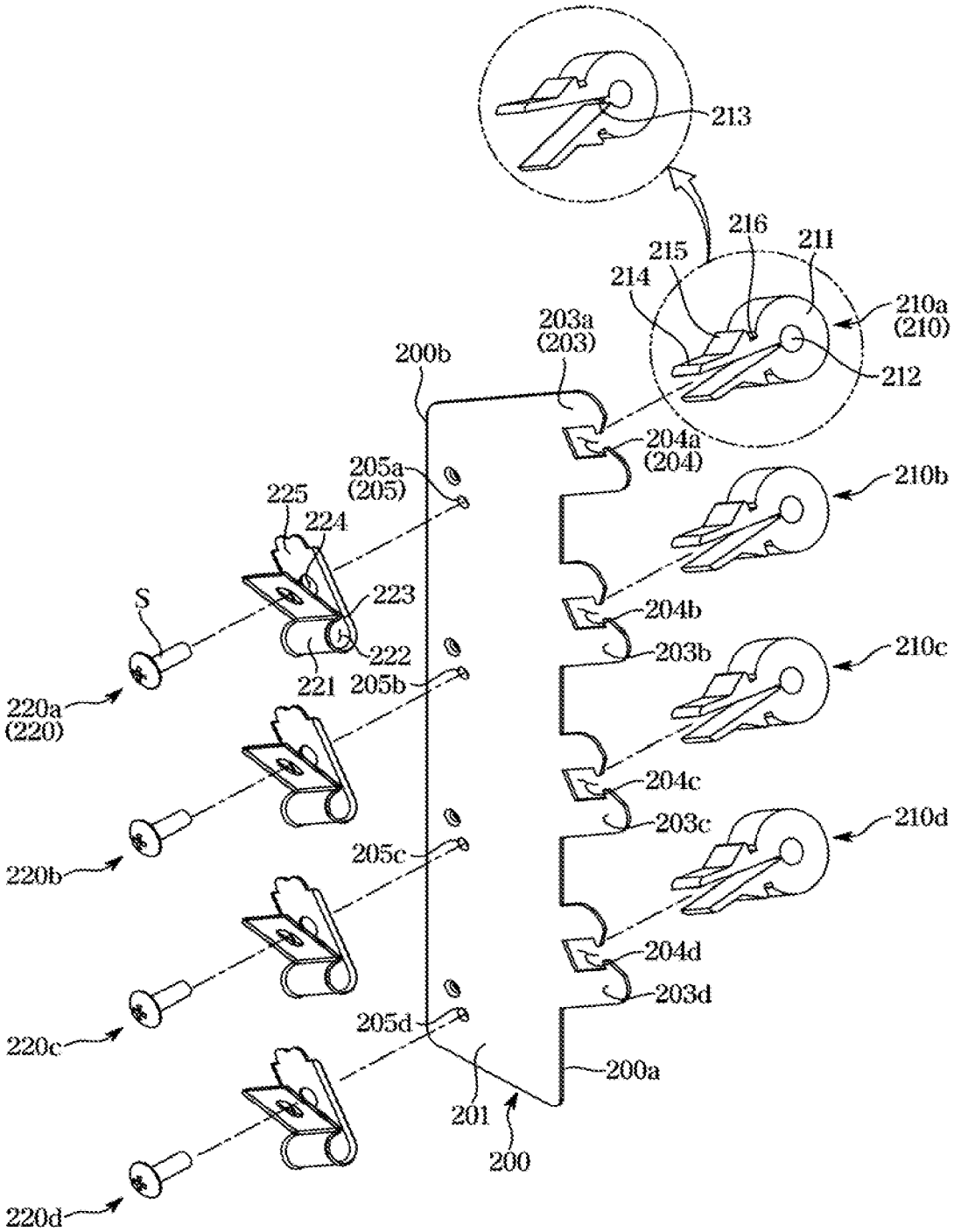
FIG. 5 is an exploded perspective view illustrating a first coupling member, a second coupling member, and the bracket in the air conditioner according to an embodiment of the disclosure.
Figure 6:
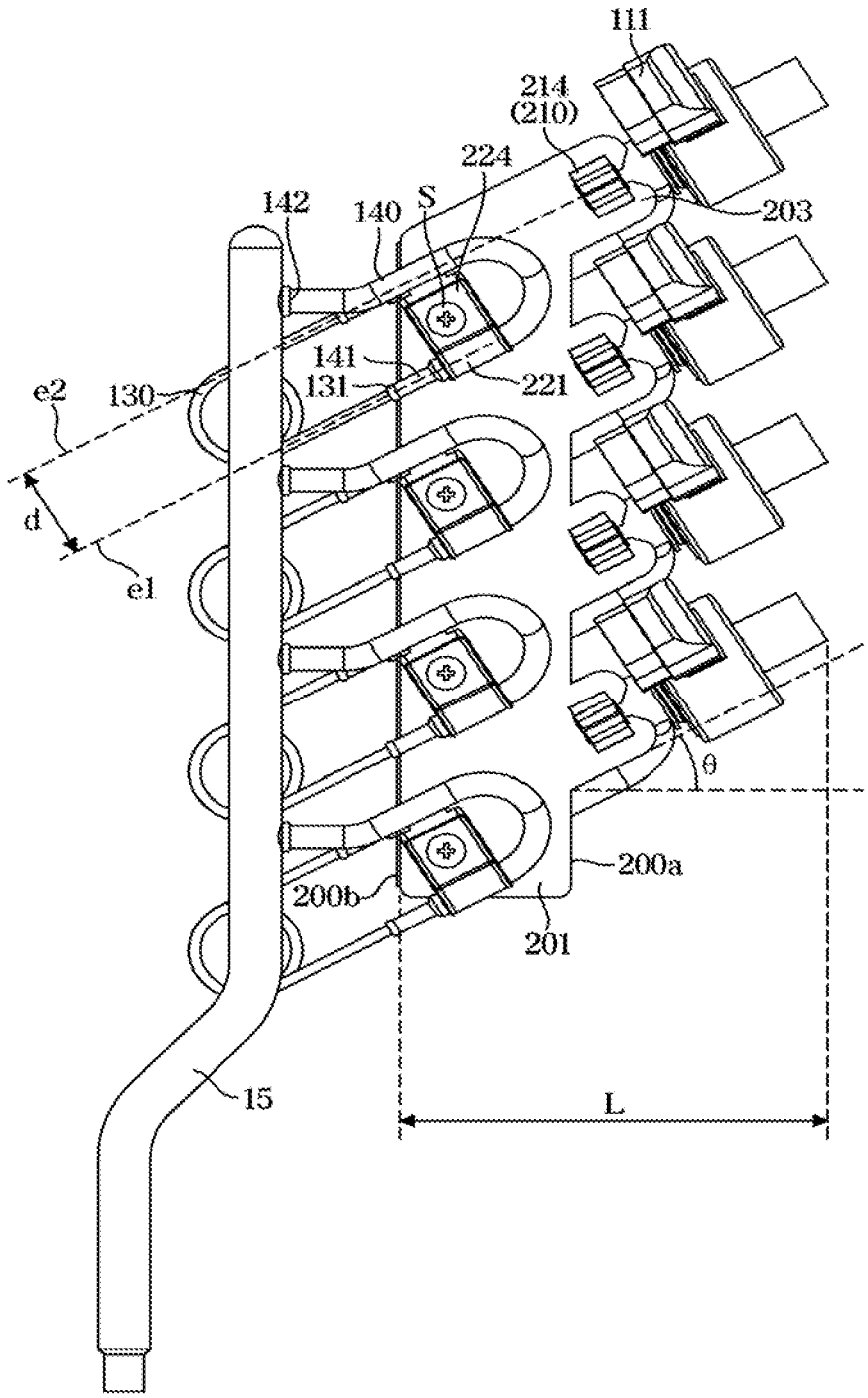
FIG. 6 is a view illustrating one surface of the bracket in a state in which the expansion valve unit is fixed to the bracket, in the air conditioner according to an embodiment of the disclosure.
Figure 7:
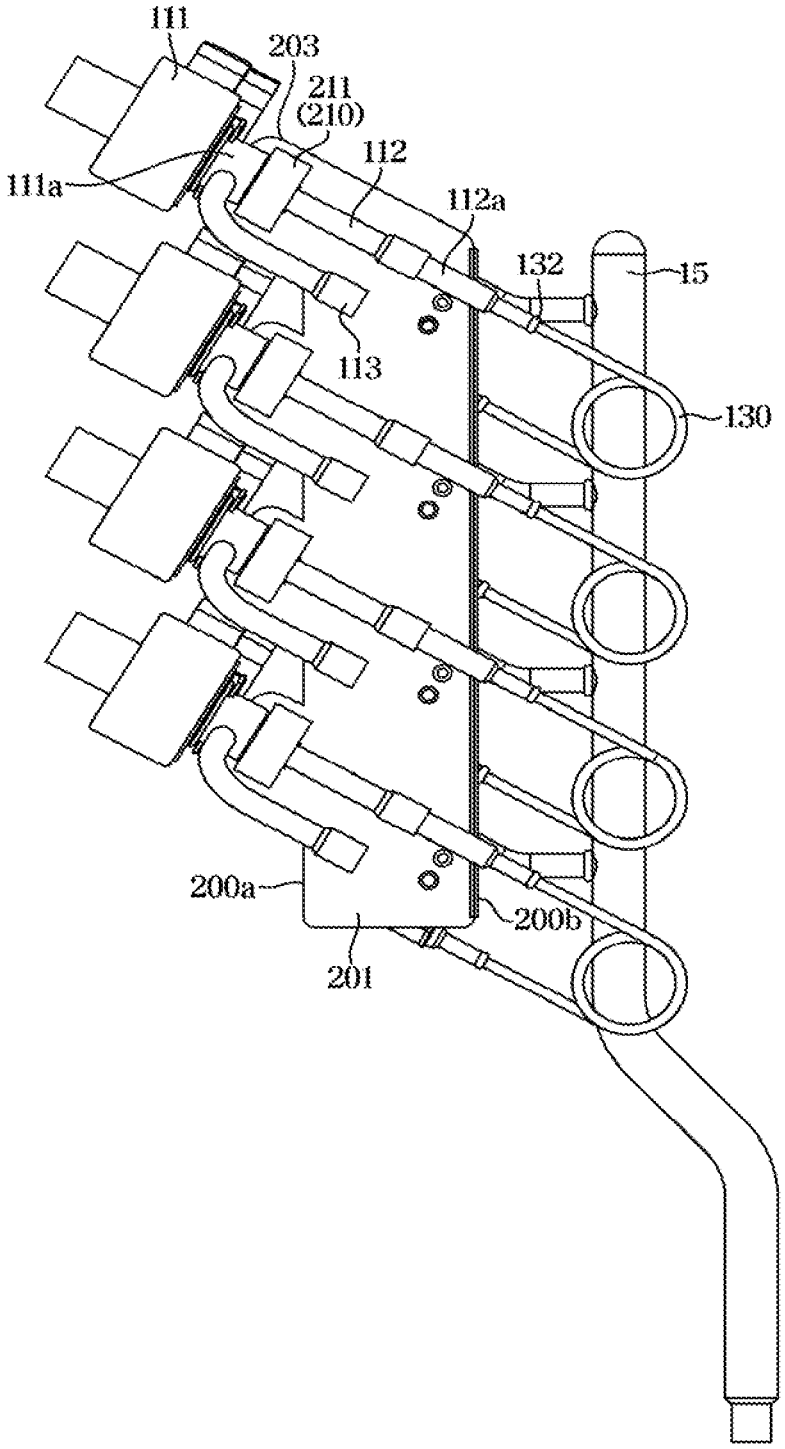
FIG. 7 is a view illustrating the other surface of the bracket in a state in which the expansion valve unit is fixed to the bracket, in the air conditioner according to an embodiment of the disclosure.

FIG. 5 is an exploded perspective view illustrating a first coupling member, a second coupling member, and the bracket in the air conditioner according to an embodiment of the disclosure, FIG. 6 is a view illustrating one surface of the bracket in a state in which the expansion valve unit is fixed to the bracket, in the air conditioner according to an embodiment of the disclosure, and FIG. 7 is a view illustrating the other surface of the bracket in a state in which the expansion valve unit is fixed to the bracket, in the air conditioner according to an embodiment of the disclosure.

The expansion valve units 100*a*, 100*b*, 100*c*, and 100*d* to be described below have the same configuration and thus any one expansion valve unit 100*a* among the expansion valve units 100*a*, 100*b*, 100*c*, and 100*d* will be described as an example of the expansion valve unit 100.

The first coupling members 210*a*, 210*b*, 210*c*, and 210*d* to be described below have the same configuration, and thus the first coupling member 210*a* corresponding to one of the plurality of first coupling members 210*a*, 210*b*, 210*c*, and 210*d* will be described as an example of the first coupling member 210.

Further, the second coupling members 220*a*, 220*b*, 220*c*, and 220*d* to be described below have the same configuration, and thus the second coupling member 220*a* corresponding to one of the plurality of second coupling members 220*a*, 220*b*, 220*c*, and 220*d* will be described as an example of the second coupling member 220.

Four coupling hooks 203*a*, 203*b*, 203*c*, and 204*d* and four coupling holes 205*a*, 205*b*, 205*c*, and 205*d* to be described later may be provided on the bracket 200 in accordance with the number of the expansion valve units 100*a*, 100*b*, 100*c*, and 100*d*.

The four coupling hooks 203*a*, 203*b*, 203*c* and 204*d* have the same configuration and the four coupling holes 205*a*, 205*b*, 205*c* and 205*d* have the same configuration. Therefore, one coupling hook 203*a* among the plurality of coupling hooks 203*a*, 203*b*, 203*c* and 204*d* will be described as an example of the coupling hook 203 and one coupling hole

205*a* among the plurality of coupling holes 205*a*, 205*b*, 205*c* and 205*d* will be described as an example of the coupling hole 205.

Further, one guide hole 206*a* among the plurality of guide holes 206*a*, 206*b*, 206*c*, and 206*d* to be described later will be described as an example of the guide hole 206.

As illustrated in FIGS. 5 to 7, the bracket 200 may be configured to fix the expansion valve 110 and the first connection portion 120.

The expansion valve 110 may be coupled by the first coupling member 210, and the first connection portion 120 may be coupled by the second coupling member 220.

Particularly, the second coupling member 220 may fix the first connection tube 140 among the first connection portion 120 to the bracket 200. Alternatively, the second coupling member 220 may fix the capillary tube 130, which is instead of the first connection tube 140, to the bracket 200 although not shown in the drawing.

The first coupling member 210 may surround at least a portion of the expansion valve 110 and then fixed to the bracket 200 so as to allow the expansion valve 110 to be stably supported by the bracket 200.

Particularly, the first coupling member 210 may surround a lower portion 111*a* of the body portion 111 of the expansion valve 110 to stably support the body portion 111 having a relatively heavy weight. However, the disclosure is not limited thereto, and the first coupling member 210 may surround other portions of the body portion 111.

Accordingly, because the body portion 111 is fixed to the bracket 200, it is possible to allow the external force, which is generated by the weight of the body portion 111, to be minimally transmitted to the first tube 112 extending from the body portion 111 and the other end 132 of the capillary tube 130, which is connected to the first tube 112.

The first coupling member 210 may include a first cutout portion 213, and a first support 211 configured to surround and support the body portion 111 inserted through the first cutout portion 213.

The first support 211 may be formed in a ring shape with one side cut off. The first cutout portion 213 may be arranged at one side of the first support 211.

A first inserting portion 212, which is a space into which the body portion 111 may be inserted, may be provided inside the first support 211.

The lower portion 111*a* of the body portion 111 may be inserted into the first insertion portion 212 through the first cutout portion 213, and an inner circumferential surface of the first support 211 may surround an outer circumferential surface of the lower portion 111*a* of the body portion 111, thereby supporting the body portion 111.

The first coupling member 210 may include a rubber material. Accordingly, a cut range of the first cutout portion 213 may be increased or decreased by an external force, and thus the body portion 111 may be easily inserted into the first insertion portion 212.

The first coupling member 210 may include a first coupling portion 214 extending from the first cutout portion 213 to the opposite side of the first support 211 and coupled to the bracket 200.

The first coupling portion 214 may be provided in a pair of protrusion shapes extending from the first cutout portion 213. The first coupling portion 214 may be hooked to an inner space 204 of the coupling hook 203 formed in the bracket 200.

As mentioned above, the first coupling member 210 includes the rubber material and the elasticity may be maintained so that the pair of protrusion shapes of the first coupling portion 214 is directed to the outside. When the pair of coupling protrusions is arranged in the inner space 204 of the coupling hook 203, the pair of coupling protrusions may be hooked to the coupling hook 203 by the elasticity.

Further, the first coupling member 210 may include a support protrusion 215 arranged on the first coupling portion 214 to prevent the first coupling member 210 from being separated from the coupling hook 203.

Because a coupling space 216 between the support protrusion 215 and the first support 211 is arranged in the inner space 204 of the coupling hook 203, it is possible to maintain a state in which the first coupling portion 214 is stably coupled to the coupling hook 203.

Because the first coupling member 210 includes the rubber material as mentioned above, it is possible to generate the anti-vibration effect against the vibration generated in the outdoor unit 10. Accordingly, the first coupling member 210 may stably couple the expansion valve unit 100 to the bracket 200, and further secure the rigidity of the expansion valve unit 100.

The second coupling member 220 may include a second support 221 configured to surround and support the first connection tube 140, a second insertion portion 222 provided inside the second support 221 and to which the first connection tube 140 is inserted, and a second cutout portion 223 formed cutout to allow the first connection tube 140 to be inserted to the second insertion portion 222.

As for the first connection tube 140, the second support 221 may surround the vicinity of the one end 141 of the first connection tube 140 coupled to the one end 131 of the capillary tube 130.

Alternatively, the second support 221 may surround the one end 141 of the first connection tube 140 or the one end 131 of the capillary tube 130 although not shown in the drawings.

That is, in the first connection portion 120, the one end 131 of the capillary tube 130, the one end 141 of the first connection tube 140, and the vicinity of the one end 141 of the first connection tube 140, which are a portion vulnerable to damage due to external force, may be supported by the second support 221, thereby increasing the rigidity of the first connection portion 120.

In addition, as described above, the rigidity of the other end of the capillary tube 130, the first tube 112 or a portion arranged in the auxiliary tube 112*a*, which are another portion vulnerable to damage due to external force, in the first connection portion 120 may be increased because the first coupling member 210 stably supports the body portion 111.

The second coupling member 220 may include a second coupling portion 224 extending from the second cutout portion 223 to the opposite side of the second support 221 and coupled to the bracket 200.

The second coupling portion 224 may be screwed to the coupling hole 205 formed in the bracket 200. The second coupling portion 224 includes a pair of plates extending from the second cutout portion 223, and each plate may include a through hole 224 to which the screw S is passed through and which is coupled to the coupling hole 205.

The bracket 200 may include the guide hole 206 arranged adjacent to the coupling hole 205 and configured to guide a position at which the second coupling member 220 is coupled to the bracket 200.

As will be described later, the expansion valve unit 100 may be arranged to be inclined with respect to one end 200*a* or the other end 200*b* of the bracket 200. The guide hole 206 may guide the position of the second coupling member 220 to allow the second coupling member 220 to be coupled to the bracket 200 at an angle in consideration of an installation angle of the expansion valve unit 100.

The second coupling member 220 may include a guide protrusion 226 inserted into the guide hole 206. Particularly, the guide protrusion 226 may protrude from the second coupling portion 224, which is in contact with one surface 201 of the bracket 200, to a direction coupled to the bracket 200.

Before the second coupling member 220 is coupled to the bracket 200, the guide protrusion 226 may be inserted into the guide hole 205 of the bracket 200 so as to select the position of the second coupling member 220. Thereafter, the second coupling member 220 may be arranged at a position where the coupling hole 205 and the through hole 224 overlap each other, and the second coupling member 220 and the bracket 200 may be coupled to each other through the screw member S.

As mentioned above, the first coupling member 210 and the second coupling member 220 may fix the expansion valve unit 100 to the bracket 200. Accordingly, two fixation points in the expansion valve unit 100 may be fixed to the bracket 200 by the first coupling member 210 and the second coupling member 220.

Particularly, the first coupling member 210 and the second coupling member 220 may increase the rigidity of the expansion valve unit 100 by fixing the low rigidity portion of the expansion valve unit 100 to the bracket 200.

The first connection tube 140 may be fixed to the one surface 201 of the bracket 200 by the second coupling member 220, and the expansion valve 110 may be fixed to the other surface 202 of the bracket 200, which is opposite do the one surface 201 of the bracket 200, by the first coupling member 210.

That is, the first coupling member 210 and the second coupling member 220 may respectively fix the expansion valve 110 and the first connecting pipe 140 to the bracket 200 in the opposite direction.

When the first coupling member 210 and the second coupling member 220 are simultaneously coupled on the same surface of the bracket 200, a part of the expansion valve unit 100 may be deformed by the shape of the capillary tube 130. However, according to an embodiment of the disclosure, because the expansion valve 110 is coupled to the other surface 202 of the bracket 200 and the first connection tube 140 is coupled to the one surface 201 of the bracket 200, the expansion valve unit 100 may be easily coupled to the bracket 200 without deformation.

Alternatively, when the capillary tube 130 is arranged on the second connection portion 150 as described above, the expansion valve 110 may be arranged on the one surface 201 of the bracket 200 and the second connection portion 150 may be arranged on the other surface 202 of the bracket 200 by the second coupling member 220 although not shown in the drawings.

The coupling hook 203 may extend outwardly from the one end 200*a* of the bracket 200. The coupling hole 205 may be arranged at a portion adjacent to the other end 200*b* arranged in the opposite direction of the one end 200*a* of the bracket 200.

That is, on the same surface of the bracket 200, the coupling hook 203 and the coupling hole 205 may be arranged adjacent to opposite ends 200*a* and 200*b*, respectively.

Therefore, the expansion valve unit 100 may be coupled to the bracket 200 by being constrained in a region adjacent to the one end 200*a* of the bracket 200 and a region adjacent to the other end 200*b*.

The plurality of coupling hooks 203*a*, 203*b*, 203*c*, and 203*d* and the plurality of coupling holes 205*a*, 205*b*, 205*c* and 205*d* may be arranged in a direction in which the one end 200*a* or the other end 200*b* of the bracket 200 extends.

In a single bracket 200, the plurality of expansion valve units 100*a*, 100*b*, 100*c* and 100*d* may be arranged in parallel in the longitudinal direction of the bracket 200.

Accordingly, the pipe laying in the machine room may have a simple structure and thus the inner space of the machine room may be efficiently used. Therefore, it is possible to minimize collision between components and it is possible to prevent that each expansion valve unit 100*a*, 100*b*, 100*c*, and 100*d* are damaged due to collision with each other.

The coupling hook 203 may extend outwardly at a predetermined angle θ with respect to a direction perpendicular to the extending direction of the one end 200*a* or the other end 200*b* of the bracket 200.

That is, the coupling hook 203 may extend in a direction inclined with respect to the one end 200*a* of the bracket 200. Accordingly, the expansion valve unit 100 may be coupled at an angle with respect to the one end 200*a* or the other end 200*b* of the bracket 200.

A length L from the other end 200*b* of the bracket 200 to one end of the body portion 111 of the expansion valve unit 100 when the expansion valve unit 100 is coupled to the bracket 200 in a direction inclined with respect to the one end 200*a* of the bracket 200 may be less than a length from the other end 200*b* of the bracket 200 to one end of the body portion 111 of the expansion valve unit 100 when the expansion valve unit 100 is coupled to the bracket 200 in a direction perpendicular to the one end 200*a* of the bracket 200.

Therefore, the length from the outermost side of the expansion valve unit 100 coupled to the discharge pipe 15 to the discharge pipe 15 may be formed relatively short, and thus it is possible to efficiently use the inner space of the machine room.

When it is assumed that a direction, in which the one end 131 of the capillary tube 130 is formed (or a direction in which one side of the capillary tube 130 including the one end 131 extends), is e1 and it is assumed that a direction, in which the other end 132 of the capillary tube 130 is formed (or a direction in which the other side of the capillary tube 130 including the other end extends), is e2, the first coupling member 210 may constrain the expansion valve 110 in the direction e2 and the second coupling member 220 may constrain the first connection tube 140 in the direction e1.

Accordingly, even when the external force is applied to a direction in which the one end 131 and the other end 132 of the capillary tube 130 are away from each other, or a direction in which the one end 131 and the other end 132 of the capillary tube 130 are close to each other, it is possible to prevent that the capillary tube 130 is deformed in the direction in which the one end 131 and the other end 132 are away from each other or close to each other.

That is, the bracket 200 may support the expansion valve 110 and the first connection tube 140 to maintain a separation distance d in a direction perpendicular to the expanding directions e1 and e2 of the one end 131 and the other end 132 of the capillary tube 130.

Because the separation distance d between the one end 131 and the other end 132 of the capillary tube 130 is maintained by the first coupling member 210 and the second coupling member 220, it is possible to prevent the capillary tube 130 from being deformed due to the external force.

Hereinafter a bracket 300 configured to stably support the expansion valve unit 100 according to another embodiment of the disclosure will be described. A configuration to be described later except the bracket 300 may be the same as the configuration of the outdoor unit 10 of the air conditioner according to an embodiment and thus a description thereof will be omitted.

Figure 8:
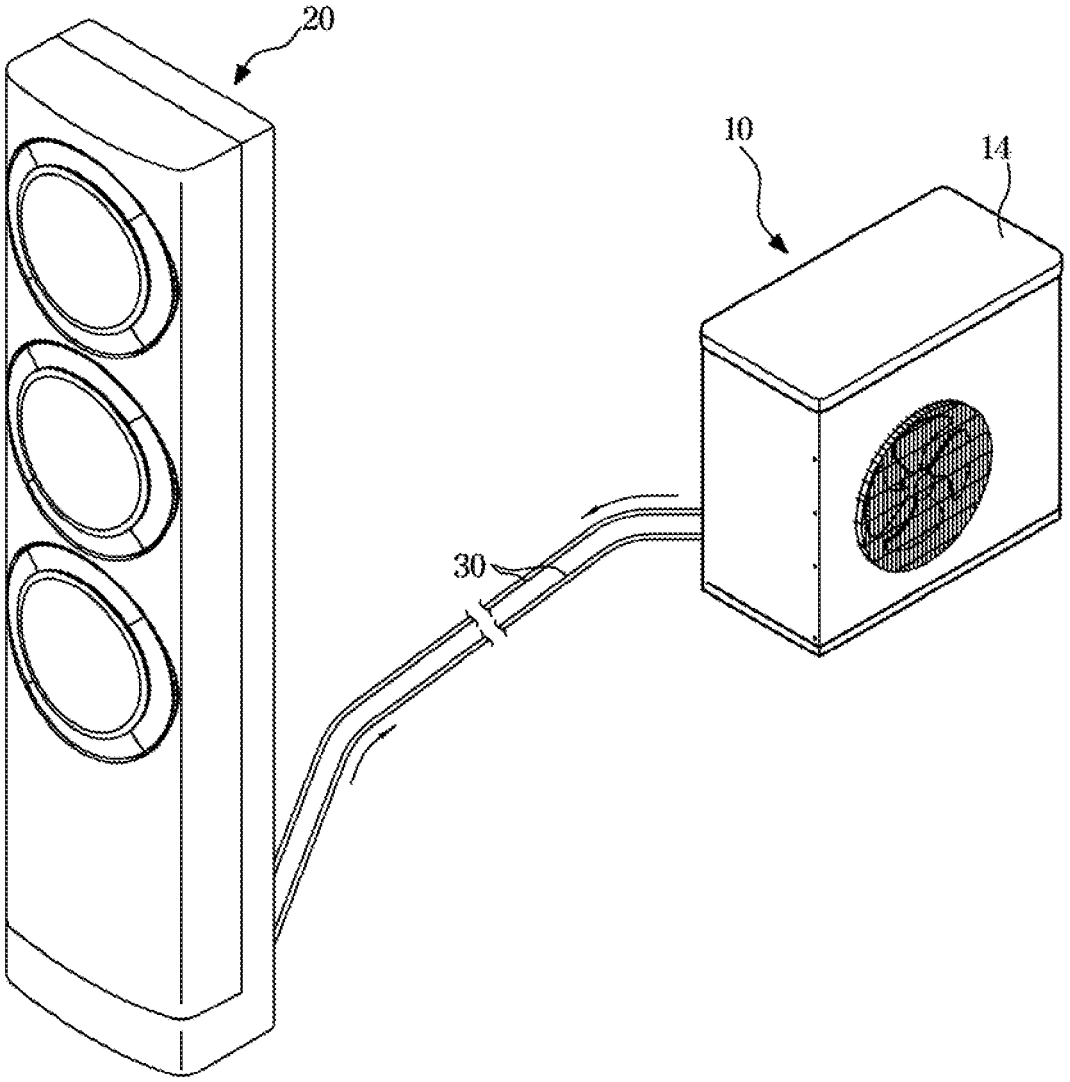
FIG. 8 is a schematic diagram of an air conditioner according to another embodiment of the disclosure.
Figure 9:
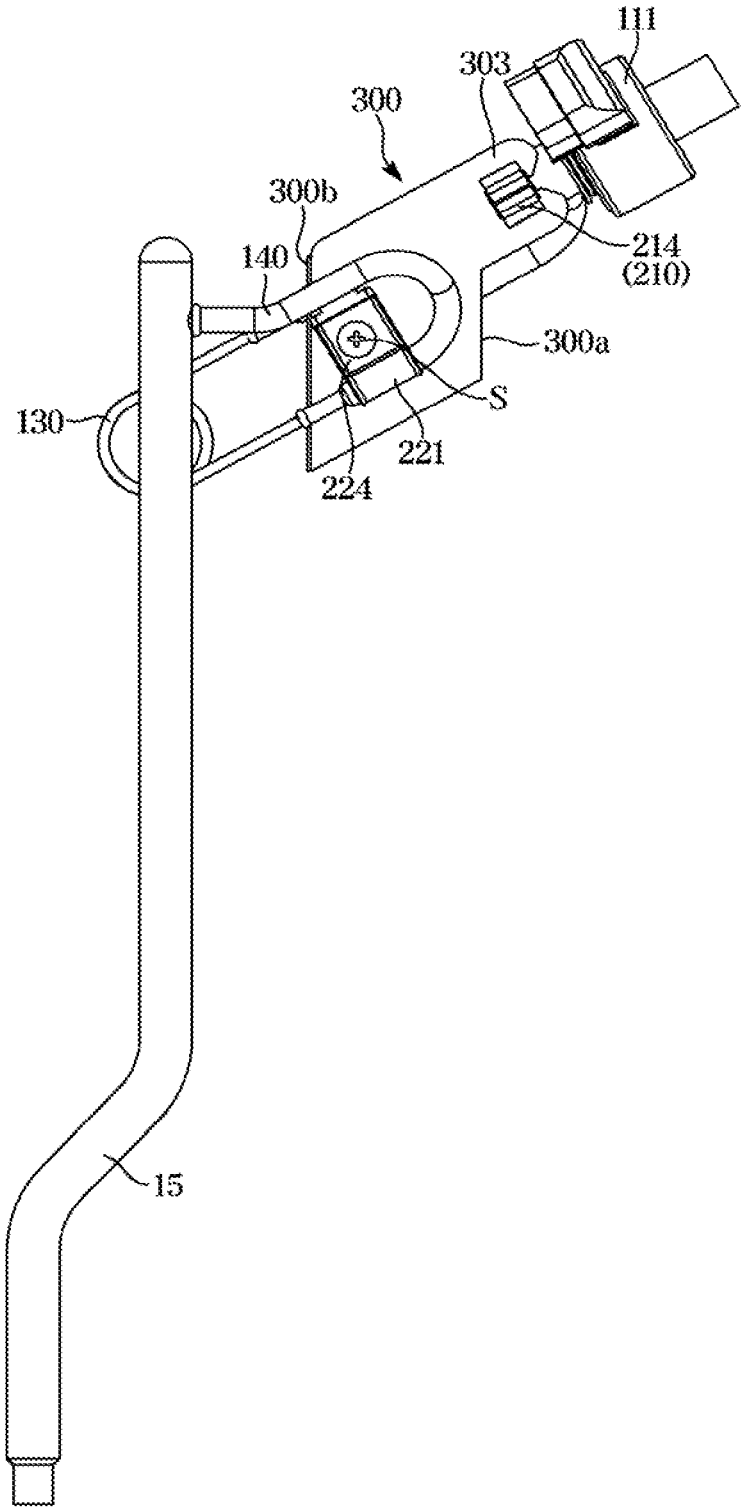
FIG. 9 is a view illustrating one surface of a bracket in a state in which an expansion valve unit is fixed to the bracket, in the air conditioner according to another embodiment of the disclosure.

FIG. 8 is a schematic diagram of an air conditioner according to another embodiment of the disclosure, and FIG. 9 is a view illustrating one surface of a bracket in a state in which an expansion valve unit is fixed to the bracket, in the air conditioner according to another embodiment of the disclosure.

As illustrated in FIG. 8, a single indoor unit 20 may be connected to a single outdoor unit 10. Accordingly, a single expansion valve unit 100 may be arranged in the outdoor unit 10.

When a single expansion valve unit 100 is arranged in the machine room, the expansion valve unit 100 may be coupled to any one of the plurality of coupling hooks 203*a*, 203*b*, 203*c* and 203*d* and any one of the plurality of coupling holes 205*a*, 205*b* and 205*c* in the bracket 200.

However, unlike this, the bracket 300 according to another embodiment of the disclosure may include one coupling hook 303 and one coupling hole (not shown).

Accordingly, a length of one end 300*a* or the other end 300*b* of the bracket 300 may be shortened, and thus the bracket 300 may be smaller than the bracket 200 according to an embodiment of the disclosure.

Because the size of the bracket 300 is reduced, the space inside the machine room of the outdoor unit 10 may be effectively used, and thus the expansion valve unit 100 may be prevented from being damaged due to contact with other components.

In addition, although not shown in the drawings, the bracket 300 may be implemented by a bracket including two coupling hooks and two coupling holes, or three coupling hooks and three coupling holes.

That is, unlike an embodiment of the disclosure or another embodiment of the disclosure, the bracket may include various numbers of coupling hooks and coupling holes.

As is apparent from the above description, the expansion valve unit of the outdoor unit of the air conditioner may be stably supported by the bracket, without the movement, and thus it is possible to effectively prevent the capillary tube, which is arranged in the front end or the rear of the expansion valve unit, from being damaged.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. An outdoor unit of an air conditioner connectable to an indoor unit, the outdoor unit comprising:

a compressor;

a heat exchanger configured to exchange heat between air introduced from outside and refrigerant compressed by the compressor;

an expansion valve unit configured to decompress the refrigerant discharged from the heat exchanger;

a refrigerant pipe configured to deliver the refrigerant, which is decompressed and expanded by the expansion valve unit, to the indoor unit therethrough when the indoor unit is connected to the outdoor unit; and a bracket configured to support the expansion valve unit, wherein the expansion valve unit comprises an expansion valve, a first connection portion configured to connect the expansion valve to the heat exchanger, and a second connection portion configured to connect the expansion valve to the refrigerant pipe, the one of the first connection portion or the second connection portion comprises: a capillary tube connected to the expansion valve; and a connection tube connected to the capillary tube and one of the heat exchanger or the refrigerant pipe, and the bracket fixes the expansion valve and the connection tube connected to the capillary tube thereto so that both ends of the capillary tube are supported by the bracket.

2. The outdoor unit of the air conditioner of claim 1, wherein the expansion valve is fixed to one surface of the bracket, and the one of the first connection portion or the second connection portion is fixed to an opposite surface of the bracket.

3. The outdoor unit of the air conditioner of claim 1, wherein the expansion valve is fixed to one side of the bracket, and the one of the first connection portion or the second connection portion is fixed to an opposite side of the bracket.

4. The outdoor unit of the air conditioner of claim 1, wherein the capillary tube comprises one end thereof connected to the connection tube and an other end thereof connected to the expansion valve, and the bracket fixes the expansion valve and the connection tube to maintain a separation distance in a direction perpendicular to an extending direction of the one end and the other end of the capillary tube.

5. The outdoor unit of the air conditioner of claim 1, further comprising:

a first coupling member configured to surround at least a portion of the expansion valve and coupled to the bracket so as to allow the expansion valve to be coupled to the bracket.

6. The outdoor unit of the air conditioner of claim 5, wherein the first coupling member comprises a rubber material.

7. The outdoor unit of the air conditioner of claim 5, wherein the first coupling member comprises a first cutout portion, a first support configured to support at least one portion of the expansion valve after a lower end of the expansion valve is inserted through the first cutout portion, and a first coupling portion extending from the first cutout portion and coupled to the bracket.

8. The outdoor unit of the air conditioner of claim 7, wherein the first coupling portion comprises a support protrusion configured to allow the first coupling portion to be supported by the bracket without being separated from the bracket after the first coupling portion is inserted into the bracket.

9. The outdoor unit of the air conditioner of claim 8, wherein the bracket comprises a coupling hook comprising an insertion portion to which the first coupling portion is inserted.

10. The outdoor unit of the air conditioner of claim 9, wherein the coupling hook is arranged at one side end of the bracket.

11. The outdoor unit of the air conditioner of claim 5, further comprising:

a second coupling member configured to surround one of the first connection portion or the second connection portion and coupled to the bracket so as to allow the one of the first connection portion or the second connection portion to be coupled to the bracket.

12. The outdoor unit of the air conditioner of claim 11, wherein the first coupling member comprises a first cutout portion, a first support configured to support at least one portion of the expansion valve after a lower end of the expansion valve is inserted through the first cutout portion, and a first coupling portion extending from the first cutout portion and coupled to the bracket, and the second coupling member comprises a second support configured to surround the one of the first connection portion or the second connection portion and support the one of the first connection portion or the second connection portion, and a second coupling portion coupled to the bracket.

13. The outdoor unit of the air conditioner of claim 12, wherein the second coupling portion is screwed to the bracket, and the bracket further comprises a coupling hole to which the second coupling portion is screwed.

14. An outdoor unit of an air conditioner connectable to an indoor unit, the outdoor unit comprising:

a compressor;

a heat exchanger configured to exchange heat between air introduced from outside and refrigerant compressed by the compressor;

an expansion valve unit configured to decompress the refrigerant discharged from the heat exchanger;

a refrigerant pipe configured to deliver the refrigerant, which is decompressed and expanded by the expansion valve unit, to the indoor unit therethrough when the indoor unit is connected to the outdoor unit; and a bracket configured to support the expansion valve unit, wherein the expansion valve unit comprises an expansion valve, a first connection portion to connect the expansion valve to the heat exchanger, and a second connection portion to connect the expansion valve to the refrigerant pipe, and the expansion valve is coupled to one surface of the bracket, one of the first connection portion or the second connection portion is coupled to an opposite surface of the bracket so that the expansion valve unit is supported by both the one surface of the bracket and the opposite surface of the bracket in opposite coupling directions.

15. The outdoor unit of the air conditioner of claim 14, further comprising:

a first coupling member configured to surround a lower portion of the expansion valve and coupled to the bracket so as to allow the lower portion of the expansion valve to be coupled to the bracket, and a second coupling member configured to surround one of the first connection portion or the second connection portion and coupled to the bracket so as to allow the one of the first connection portion or the second connection portion to be coupled to the bracket.

16. The outdoor unit of the air conditioner of claim 15, wherein the bracket comprises a coupling hook comprising an insertion portion to which the first coupling member is inserted, and a coupling hole to which the second coupling member is screwed, and the coupling hook is arranged on one side of the bracket and the coupling hole is arranged on an other side of the bracket.

17. The outdoor unit of the air conditioner of claim 16, wherein the first coupling member comprises a rubber material.

18. An outdoor unit of an air conditioner connectable to an indoor unit, the outdoor unit comprising:

a compressor;

a heat exchanger configured to exchange heat between air introduced from outside and refrigerant compressed by the compressor;

an expansion valve unit configured to decompress the refrigerant discharged from the heat exchanger;

a refrigerant pipe configured to deliver the refrigerant, which is decompressed and expanded by the expansion valve unit, to the indoor unit therethrough when the indoor unit is connected to the outdoor unit; and a bracket configured to support the expansion valve unit, wherein the expansion valve unit comprises an expansion valve, a capillary tube comprising one end thereof connected to the expansion valve, and a connection tube to connect an other end of the capillary tube to the heat exchanger or the refrigerant pipe, and the bracket fixes the expansion valve and the connection tube thereto to maintain a separation distance in a direction perpendicular to an extending direction of the one end and the other end of the capillary tube.

* * * * *